US010252279B2

(12) United States Patent
Ohkawara et al.

(10) Patent No.: US 10,252,279 B2
(45) Date of Patent: Apr. 9, 2019

(54) CENTRIFUGE HAVING LIGHT EMITTING PART

(71) Applicant: HITACHI KOKI CO., LTD., Tokyo (JP)

(72) Inventors: Tadashi Ohkawara, Ibaraki (JP); Yoshitaka Niinai, Ibaraki (JP); Hiroshi Hayasaka, Ibaraki (JP); Takeshi Taniguchi, Ibaraki (JP); Hisanobu Ooyama, Ibaraki (JP); Hiroyuki Takahashi, Ibaraki (JP)

(73) Assignee: KOKI HOLDINGS CO., LTD., Tokyo (JP)

( * ) Notice: Subject to any disclaimer, the term of this patent is extended or adjusted under 35 U.S.C. 154(b) by 251 days.

(21) Appl. No.: 14/573,329

(22) Filed: Dec. 17, 2014

(65) Prior Publication Data

US 2015/0174590 A1 Jun. 25, 2015

(30) Foreign Application Priority Data

Dec. 19, 2013 (JP) ..... 2013-262325

(51) Int. Cl.
*B04B 7/02* (2006.01)
*B04B 7/06* (2006.01)
(Continued)

(52) U.S. Cl.
CPC ..... *B04B 11/00* (2013.01); *B04B 7/02* (2013.01); *B04B 7/06* (2013.01); *B04B 13/00* (2013.01); *B04B 15/00* (2013.01)

(58) Field of Classification Search
CPC ..... B04B 7/02; B04B 2007/025; B04B 13/00; B04B 5/02; B04B 7/06; B04B 11/00; B04B 15/00
(Continued)

(56) References Cited

U.S. PATENT DOCUMENTS 5,287,265 A * 2/1994 Hall ..... B04B 13/00 494/10
9,393,577 B2 * 7/2016 Hodotsuka ..... B04B 9/10
(Continued)

FOREIGN PATENT DOCUMENTS

CN 201510942 U 6/2010
CN 103447171 A 12/2013
(Continued)

OTHER PUBLICATIONS

Machine Translation of JP 2004-105567 dated Apr. 2004.*
(Continued)

*Primary Examiner* — Charles Cooley
(74) *Attorney, Agent, or Firm* — Kenealy Vaidya LLP

(57) ABSTRACT

A centrifuge including a rotor, a rotor chamber having an opening, a motor, a door configured to close the opening, an input/output unit configured to receive an input of an operating condition and to display an operating status, and a housing accommodating therein the rotor, the rotor chamber, the motor, the door and the input/output unit, wherein the housing has the opening at an upper surface thereof, wherein a light emitting part having a horizontal width longer than the opening is provided in the vicinity of a corner portion at which the upper surface and a front surface of the housing intersect with each other or in the vicinity of a front side of the opening, and wherein a light emitting form of the light emitting part is configured to be changed depending on the operating status.

8 Claims, 10 Drawing Sheets

(51) Int. Cl.
*B04B 11/00* (2006.01)
*B04B 13/00* (2006.01)
*B04B 15/00* (2006.01)

(58) Field of Classification Search
USPC ..... 494/7–11, 16–21, 84; 700/273; 422/72; 210/85, 143
See application file for complete search history.

(56) References Cited

U.S. PATENT DOCUMENTS 9,433,948 B2 * 9/2016 Kusumoto ..... B04B 15/02
9,517,476 B2 * 12/2016 Ooyama ..... B04B 9/10
9,656,275 B2 * 5/2017 Ooyama ..... B04B 11/00
9,956,564 B2 * 5/2018 Rogers ..... B04B 5/0442
2003/0199378 A1 * 10/2003 Saviano ..... B04B 15/02 494/11
2003/0199379 A1 * 10/2003 Schneider ..... B04B 13/00 494/11
2007/0132723 A1 * 6/2007 Lurz ..... B01L 99/00 345/156
2007/0149378 A1 * 6/2007 Takahashi ..... B04B 13/00 494/1
2011/0059835 A1 * 3/2011 Takahashi ..... B04B 9/10 494/10
2011/0207590 A1 * 8/2011 Ooyama ..... B04B 9/10 494/9
2011/0230327 A1 * 9/2011 Takahashi ..... B04B 13/00 494/10
2014/0121094 A1 * 5/2014 Hodotsuka ..... B04B 9/10 494/7
2015/0174590 A1 * 6/2015 Ohkawara ..... B04B 13/00 494/10
2015/0174592 A1 * 6/2015 Ooyama ..... B04B 11/00 494/10

FOREIGN PATENT DOCUMENTS

EP 344453 A2 * 12/1989
JP 2002-306988 A 10/2002
JP 2004-105567 * 4/2004
JP 2004-105567 A 4/2004
JP 2007-136314 A 6/2007
JP 2007-136318 A 6/2007
JP 2008-183544 * 8/2008
JP 2008-183544 A 8/2008
JP 2013-244441 A 12/2013
WO 2013-032262 A2 3/2013
WO 2017/115595 A1 * 7/2014

OTHER PUBLICATIONS

Machine Translation of JP 2008-183544 dated Aug. 2008.*
Japanese Office Action for the related Japanese Patent Application No. 2013-262325 dated Apr. 25, 2017.
Japanese Office Action for the related Japanese Patent Application No. 2013-262325 dated Oct. 24, 2017.
Chinese Office Action for the related Chinese Patent Application No. 201410803133.2 dated Dec. 14, 2017.

* cited by examiner

EXAMPLE OF WARNING AGAINST THE SAME COLOR SETTING AS ALARM

EXAMPLE OF PREVENTING THE SAME COLOR SETTING AS ALARM

EXAMPLE OF WARNING AGAINST THE SAME COLOR SETTING

CENTRIFUGE HAVING LIGHT EMITTING PART

CROSS-REFERENCE TO RELATED APPLICATIONS

This application claims priority from Japanese Patent Application No. 2013-262325 filed on Dec. 19, 2013, the entire contents of which are incorporated herein by reference.

TECHNICAL FIELD

Aspects of the present invention relate to a display and the like of a centrifugal separator configured to separate a sample in fields of medical sciences, pharmaceuticals, biotechnologies and the like.

BACKGROUND

A centrifuge (a centrifugal separator) is to separate and refine a sample held in a rotor by putting a sample to be separated into a tube or bottle, loading the same to a rotor, accommodating the rotor in a rotor chamber, sealing the rotor chamber and rotating the rotor at high speed. The rotating speed of the rotor is different depending on utilities. A product group having a wide range of rotating speeds, such as a product having a relatively low speed of thousands of revolutions per minute (rpm), which is the maximum rotating speed, and a product having a high speed of about 150,000 revolutions per minute (rpm), which is the maximum rotating speed, is generally supplied. Among of them, a centrifuge having a rotating speed of about 40,000 rpm or higher is provided with a vacuum pump configured to decompress the rotor chamber so as to suppress windage loss (frictional heat) between air in the rotor chamber and the rotor. In general, the vacuum pump consists of an oil rotary vacuum pump functioning as a roughing vacuum pump and an oil diffusion vacuum pump for securing higher vacuum. Further, a cooling device configured to cool the rotor chamber is provided so as to keep the rotor at preset temperature.

In the centrifuge of the related art, the rotor is detachably mounted to a driving shaft. A user sets a sample container having a sample therein to the detached rotor, covers an opening of the rotor with a cover and then mounts the rotor to the driving shaft in the rotor chamber. Upon the mounting, which is performed by the user's man-power, since a distance from a floor surface to a housing upper surface of a centrifuge having a relatively large size, such as an ultracentrifuge, a high-speed refrigerated centrifuge, a large capacity refrigerated centrifuge and the like, is generally about 800 to 900 mm and a mass of the rotor to be mounted is about 20 to 30 kg (for a heavy rotor), it is very difficult to mount the rotor. In particular, when mounting the rotor under an environment in which it is difficult to visibly check the upper surface position of the centrifuge, such as a dark room, a lower part (a vicinity of an adapter) of the rotor may collide with the housing upper surface or a ridge part at which the housing upper surface and a housing front surface intersect with each other. Thereby, the centrifuge and the rotor may be damaged depending on a level of the collision. Also, when the collision occurs, vibrations are applied to the sample in the sample container, which is not preferable for a sample having a density gradient, particularly. For this reason, according to the related art, in order to prevent the collision with the ridge part of the housing upon the mounting of the rotor, a height of the housing upper surface is optimized and the housing upper surface is provided with a gradient, for example. That is, a shape of the housing is designed from ergonomic standpoints to implement an environment in which the collision is difficult to occur.

As one of functions of the centrifuge, JP-A-2007-136318 discloses a technology of enabling operating information displayed on a display unit to be checked from a distance. According to this technology, a rotation number of a motor configured to rotate the rotor having the sample inserted therein is detected by a rotation sensor and a display color of a liquid crystal display unit configured to input and output information is changed depending on operating statuses including the rotation number of the rotor detected by the rotation sensor.

SUMMARY

The technology of JP-A-2007-136318 provides the function of changing the display color of the display unit, depending on the operating statuses, so as to be able to check the operating information displayed on the display unit from a distance. However, since a screen size of the liquid crystal display unit of the display unit is not so large, the user should come close to and see the liquid crystal display unit so as to certainly check the contents of the information, and a user who is distant from the centrifuge so as to perform another operation may not see the information well. Also, the centrifuge of JP-A-2007-136318 is not provided with an illumination device becoming a guide upon the mounting and demounting of the rotor.

It is therefore an object of the present invention to provide a centrifuge in which a light emitting part, which serves as a guide when a user mounts and demounts a rotor, is provided to a housing.

Another object of the present invention is to provide a centrifuge configured to enable a user at a place distant from the centrifuge to easily discriminate mounted and demounted states of a rotor, operating statuses of the centrifuge, an error occurrence and the like by changing a light emitting form of a light emitting part.

Still another object of the present invention is to provide a centrifuge configured to enable a user to arbitrarily set a light emitting form of a light emitting part.

Representative features of the present invention disclosed in the specification are described, as follows.

According to an aspect of the present invention, there is provided a centrifuge including: a rotor; a rotor chamber accommodating therein the rotor and having an opening; a motor configured to rotate the rotor; a door configured to close the opening of the rotor chamber; an input/output unit configured to receive an input of an operating condition and to display an operating status; and a housing accommodating therein the rotor, the rotor chamber, the motor, the door and the input/output unit, wherein the housing has the opening at an upper surface thereof, wherein a light emitting part having a horizontal width longer than the opening is provided in the vicinity of a corner portion at which the upper surface and a front surface of the housing intersect with each other or in the vicinity of a front side of the opening, and wherein a light emitting form of the light emitting part is configured to be changed depending on the operating status of the centrifuge.

The above and other objects and novel features of the present invention will be apparent from the following descriptions and the drawings.

DETAILED DESCRIPTION

First Illustrative Embodiment

Figure 1:
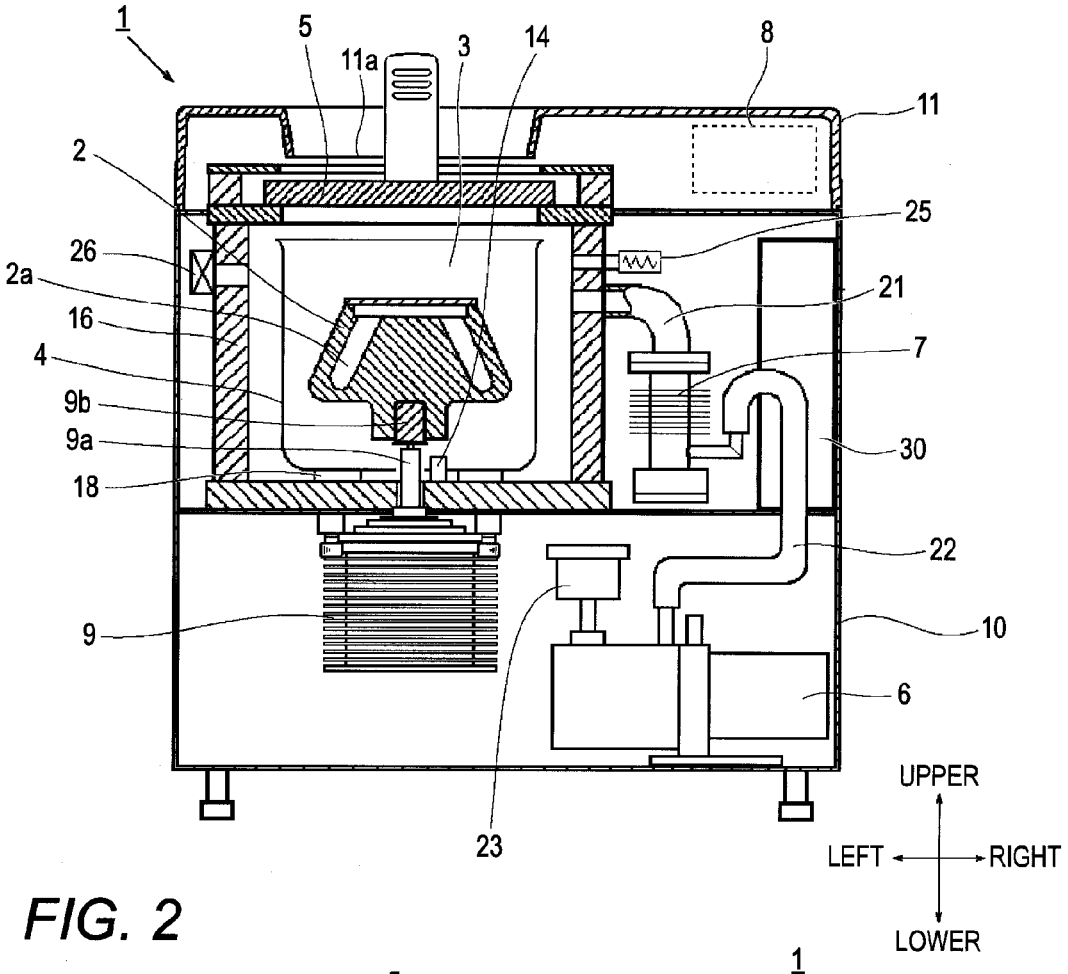
FIG. 1 is a sectional view illustrating an overall configuration of a centrifuge 1 according to an illustrative embodiment of the present invention.

A centrifuge according to illustrative embodiments of the present invention will be described with reference to the drawings. FIG. 1 is a sectional view illustrating a configuration of a centrifuge 1 according to an illustrative embodiment of the present invention. The centrifuge 1 includes a rotor 2 configured to rotate with holding therein a sample to be separated, a rotor chamber 3 configured to accommodate therein the rotor 2, a door 5 configured to open and close an opening provided to move the rotor 2 into or out of the rotor chamber 3, two vacuum pumps (an oil rotary vacuum pump 6 and an oil diffusion vacuum pump 7) configured to decompress the rotor chamber 3, an operation display unit 8 configured to receive a user's setting operation for centrifugal separation conditions and to display a variety of information about operating statuses and the like for the user, a motor 9 functioning as a driving unit configured to rotate the rotor 2, an openable air leak valve 26 configured to introduce air into the rotor chamber 3, a vacuum sensor 12 configured to measure a pressure in the rotor chamber 3, a temperature sensor (not shown) configured to measure a temperature of the rotor 2, a cooling device (not shown) configured to cool a bowl 4 and to indirectly control the temperature of the rotor 2, a rotor identifying sensor 14 configured to identify the mounted rotor 2 and a control device 30 configured to control the above-described elements.

The bowl 4 is formed at its lower part with a penetration hole communicating with an inside and an outside of the bowl 4. A rotary shaft (not shown) is configured to pass through a shaft case 9*a* extending from the motor 9 and to penetrate the penetration hole together with the shaft case 9*a*, and the rotor 2 is attached to a fitting part 9*b* of a tip of the rotary shaft. Meanwhile, the shaft case 9*a* is sealed in the penetration hole by a seal member (not shown), so that air tightness of the rotor chamber 3 can be secured. The rotor 2 is formed with a plurality of holes 2*a* for inserting tubes having a sample therein. In this illustrative embodiment, the motor 9 can operate at 150,000 revolutions per minute (rpm), for example, which is the maximum rotating speed, and the sample is centrifugally separated by a centrifugal force resulting from the rotation. In general, when the rotor 2 is rotated at high speed under atmospheric pressure, the rotor 2 generates heat due to windage loss and the high-speed rotation of the rotor 2 is suppressed by an air resistance. For this reason, when rotating the rotor 2 at high speed, it is important to evacuate the air from the rotor chamber 3 for decompression or vacuum state, thereby suppressing the windage loss.

The oil diffusion vacuum pump (DP) 7 is connected at a suction-side to the rotor chamber 3 by a vacuum piping 21 and is connected at a discharge-side to a suction port of the oil rotary vacuum pump (DR) 6 through a vacuum piping 22. The oil diffusion vacuum pump 7 is a well-known apparatus having therein a liquid oil and configured to discharge the air in the rotor chamber 3 by evaporation/condensation in the oil. In this illustrative embodiment, the oil diffusion vacuum pump 7 and the oil rotary vacuum pump 6 are connected in series, as a vacuum pump for decompressing the rotor chamber 3. A discharge-side of the oil rotary vacuum pump 6 is provided with an oil mist trap 23 for trapping oil mists contained in the exhaust air.

The control device 30 is configured to overall control the centrifuge 1 and includes a microcomputer (which will be described later) and a storage device such as a ROM, a RAM and the like. The control device 30 is configured to overall control the centrifuge 1. For example, the control device 30 is configured to input signals of the vacuum sensor 12 and a temperature sensor 13 through signal lines (not shown), to control the rotation of the motor 9, to activate and stop the oil rotary vacuum pump 6, to activate and stop the oil diffusion vacuum pump 7, to perform a cooling control on a coolant piping by controlling an operation of a compressor, to display information on the operation display unit 8, to acquire input data, to open and close the air leak valve 26, and the like.

Figure 2:
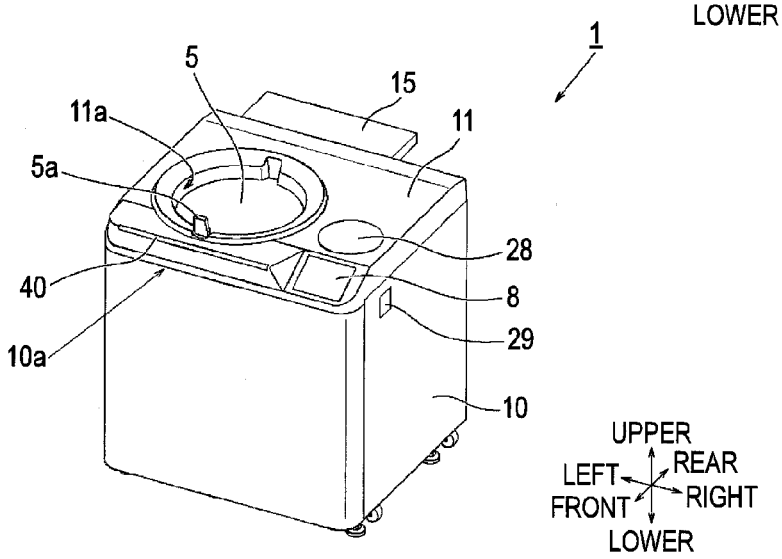
FIG. 2 is a perspective view illustrating an outward appearance of the centrifuge 1 according to the illustrative embodiment of the present invention.

FIG. 2 is a perspective view illustrating an outward appearance of the centrifuge 1 according to the illustrative embodiment of the present invention. A 'housing' of the centrifuge 1 mainly has two members, i.e., a housing main body part 10 forming front, rear, left, right and bottom surfaces and a top cover 11 configured to cover an upper surface of the housing main body part 10. The top cover 11 is formed with an opening 11*a* for access to the rotor chamber 3, and the door 5 is provided below the opening 11*a*. FIG. 2 shows a state where the rotor chamber is sealed by the door 5. In order to open the door 5, after the rotation of the rotor 2 is completely stopped, when a vacuum button 230 is pushed, the vacuum pumps 6, 7 are stopped and the air leak valve 26 (refer to FIG. 2) is released, so that the air pressure of the rotor chamber 3 becomes an atmospheric pressure. Then, the door 5 is slid from the front towards the rear with an upper end of a lever 5*a* being tilted from the front towards the rear. The top cover 11 is at its rear side with a door accommodation part 15 configured to accommodate therein the slid door 5. The right side of the opening 11*a* is attached with an elastic member 28 such as rubber, which can be used as a temporary support for a component and the like used for the centrifugal operation.

A light emitting part 40 having a predetermined horizontal width is provided at a corner part (a ridge part) on the housing upper surface of the centrifuge 1, which is located at the front side of the opening 11*a* and at which an upper part (a front side part of the top cover 11) of a coupling part 10*a* on the front surface intersects with the upper surface (the top cover 11) of the housing. The light emitting part 40 has an elongated shape of a band shape, and is configured to emit the light during the energization of the centrifuge 1, so that an overall part thereof, as seen from the outside, emits the light. Actually, although a material thereof seen from the outside does not emit the light (the light is enabled to transmit or diffuse therethrough), it seems to emit the light, as seen from the outside. A light source enabling the light emitting part 40 to emit the light can be arbitrarily implemented. In this illustrative embodiment, the light emitting part 40 is configured by a semi-transparent resin member enabling the light, which is emitted from LEDs 42 (which will be described later) arranged in the housing main body part 10, to transmit therethrough. The light emitting part 40 may be made of a transparent resin material so that the internal LEDs can be seen. However, when the light emitting part is made of a semi-transparent or white-based resin, like this illustrative embodiment, it is possible to provide a light emitting state as if it were a surface emission, and to emit the light of any color by using a color LED. In the meantime, the light emitting part 40 may be implemented using a surface-emitting device such as an EL (electroluminescence) panel and an EL illumination. Further, the light emitting part 40 may be configured to implement a light emitting pattern by the direct light or indirect light.

The operation display unit 8 is provided at the right-front side of the upper surface of the top cover 11 and at the right side of the light emitting part 40. The operation display unit 8 is a touch panel-type liquid crystal display device or EL panel, for example, and has a function as a display means (display unit) for visibly displaying information and a function as an input means (input unit) for inputting information by a user's touch operation using a finger or touch pen. In the meantime, the operation display unit 8 may be configured by an input device having input keys and a display device having no touch function, in addition to the touch panel-type liquid crystal display device. A switch unit 29 for arranging a power supply switch of the centrifuge 1 is formed at an upper part of a right side surface of the housing main body part 10. In this illustrative embodiment, the switch unit 29 is covered by a cover and the power supply switch (not shown) can be accessed by opening the cover. However, the configuration of the switch unit 29 is not limited thereto. For example, the switch unit 29 may be configured so that the power supply switch is arranged at a part recessed from an outer edge of the housing main body part 10.

Figure 3:
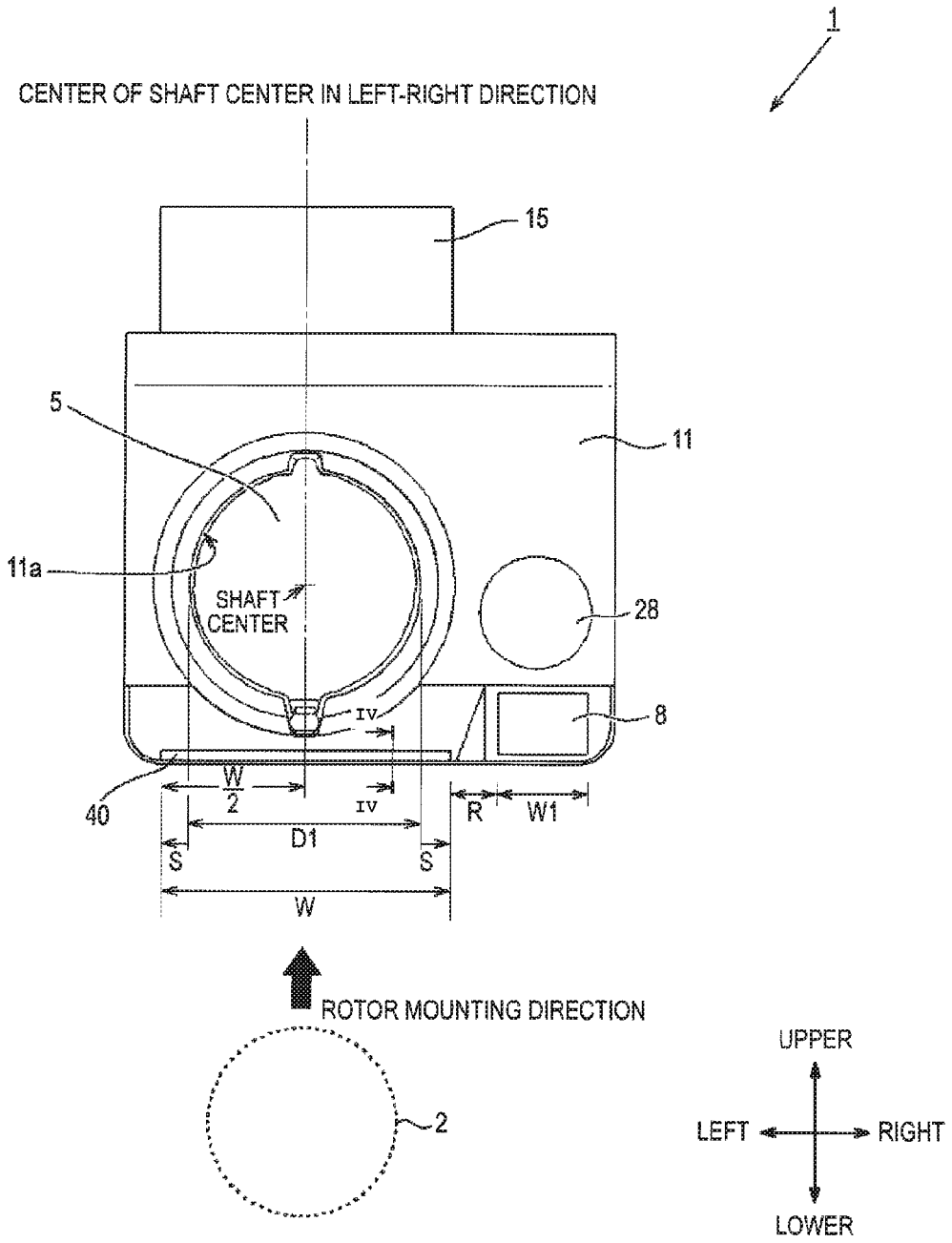
FIG. 3 is a plan view of the centrifuge 1 according to the illustrative embodiment of the present invention.

FIG. 3 is a plan view of the centrifuge 1 according to the illustrative embodiment of the present invention. It is important to arrange the light emitting part 40 at a position at which a part or all thereof can be viewed when seen from a plan view and also at a position at which a part or all of a light emission surface thereof can be viewed when seen from a front view (not shown). Here, a width W of the light emitting part 40 is configured to be sufficiently larger than a diameter D1 of the opening 11*a* of the top cover 11. At this time, the light emitting part 40 is arranged so that a line (position) of a shaft center of the rotor in the left-right direction coincides with a center line (position) of the light emitting part 40 in the left-right direction. In general, when mounting the rotor 2 into the rotor chamber 3, the user moves the rotor 2 towards the opening 11*a* from the front of the centrifuge 1, as shown with an arrow in FIG. 3. At this time, the user moves the rotor 2 into the rotor chamber 3 while passing above the light emitting part 40. The rotor 2 used in the centrifuge 1 is an integral molded product made of titanium and is about 10 to 30 kg in weight. That is, the rotor 2 does not weigh light to easily handle the same with one hand. Therefore, the user moves the rotor 2 by positioning the rotor 2 at the front of a body and securely gripping the same with two hands. At this time, when the entire light emitting part 40 emits the light over the horizontal width W of the centrifuge 1, the user can guide the rotor 2 into the rotor chamber 3 by using the light emitting position as a target. Also, a lower side of the rotor 2 is illuminated by the light emitting part 40, so that it is possible to easily see a vicinity of the lower side of the rotor 2. Therefore, it is possible to reduce concerns that the housing will collide with members provided in the vicinity of the lower end of the rotor 2, for example, an overspeed adapter, a magnetic ring configured to store the identification information of the rotor, and the like. Further, the horizontal width W of the light emitting part 40 is wider than the diameter D1 of the opening 11*a* by a width S at left and right sides, respectively. Therefore, if the user moves the rotor 2 so that partial lengths of the light emitting part 40 seen from the left and right end portions of the rotor 2 are the same at the left and right sides, when seeing the rotor 2 gripped by the user from above, it is possible to effectively guide the rotor 2 to a central position of the rotor chamber 3 in the left-right direction.

The operation display unit 8 is arranged in the vicinity of the right side of the light emitting part 40. A horizontal width W1 of the operation display unit 8 is smaller than the opening 11*a*. However, the horizontal width W of the light emitting part 40 and the horizontal width W1 are spaced by an interval R. A predetermined size of the interval R is secured, so that it is possible to effectively prevent the interference with the operation display unit 8 while mounting the rotor 2. Meanwhile, in this illustrative embodiment, as can be understood from FIG. 2, while the light emitting part 40 is formed to have a corner portion, the operation display unit 8 is obliquely arranged not to have a corner portion. Therefore, it is possible to arrange the operation display unit 8 at an angle at which the user can easily see the same. Further, since there is a space (the part corresponding to the interval R) between the operation display unit 8 and the light emitting part 40, from which the light is not emitted, it is possible to effectively prevent misidentification when using the light emitting part 40 as a positioning guide upon the mounting of the rotor 2.

Figure 4:
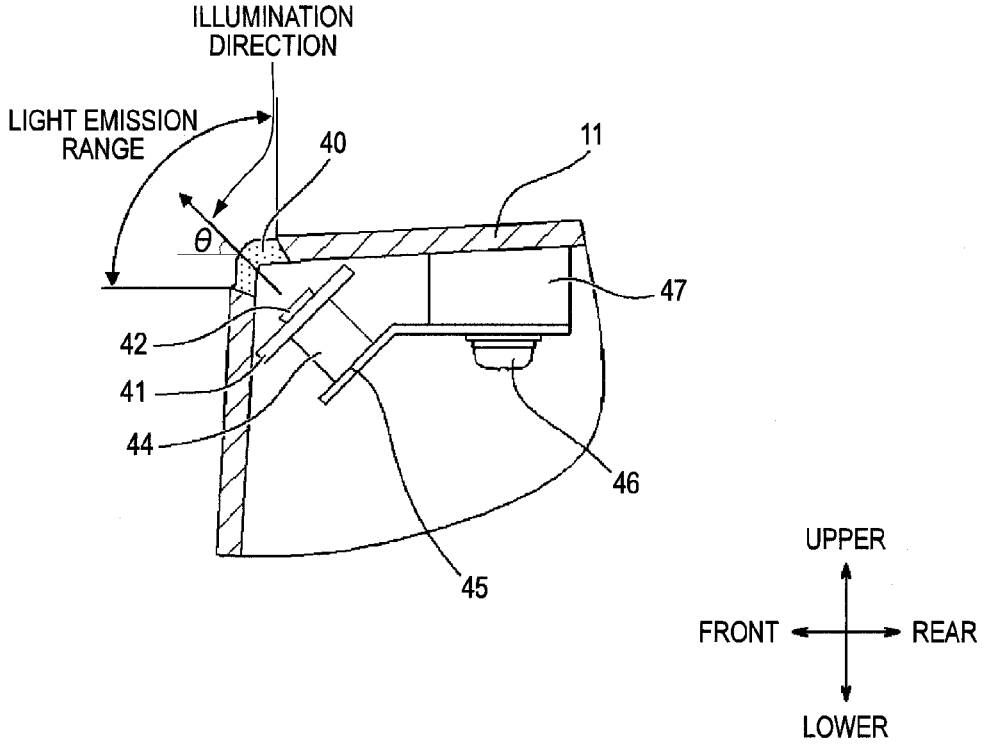
FIG. 4 is a partial sectional view taken along a line IV-IV of FIG. 3.

FIG. 4 is a partial sectional view taken along a line IV-IV of FIG. 3. In this illustrative embodiment, the light emitting part (transmissive window) 40 made of resin is provided at the corner portion of the front surface-side of the top cover 11, and the light of the LEDs 42 arranged in the housing is enabled to illuminate or diffuse to the outside through the transmission window. The light emitting part 40 may be configured (cast) integrally with the top cover 11 made of resin. Alternatively, the top cover 11 made of resin or metal may be formed with a band-shaped slit and a transmissive member made of resin may be attached to an opening of the slit. The other configuration may be also adopted. The light from the LED 42 has a high straight advance property. Therefore, when the light emitting part 40 is made of a semi-transparent synthetic resin, it is possible to appropriately diffuse the light and to implement an optimal light diffusion state so that the user's eyes are not excessively dazzled when the user sees the light emitting part 40.

The light emitting part 40 is arranged at the position ranging from the opening 11*a* of the housing to the front surface of the housing, at which a part of the light emitting part 40 can be seen both in the plan view of FIG. 3 and a front view which is not shown. In the case of a box-shaped housing, the light emitting part 40 (the transmission surface, the light diffusion surface) is preferably arranged in the vicinity of the corner portion at which the upper surface and the front surface of the housing intersect with each other, preferably on a ridge line at which the upper surface and the front surface of the housing intersect with each other. In this illustrative embodiment, a plurality of LEDs 42 is mounted on a band-shaped substrate 41, and the substrate 41 is screw-fastened to an attaching arm 45. The attaching arm 45 is fixed to an inner side of the top cover 11 by a screw 46. At this time, spacers 46, 47 are used to easily set an attaching position and an attaching angle of the substrate 41. An illumination direction of the light from the LED 42 is preferably made to face obliquely forwards. In this illustrative embodiment, the illumination direction θ of the LED 42 is set to be 45° from a horizontal plane. Since the light emitting part 40 is arranged on the ridge line of the corner portion at which the upper surface and the front surface of the housing intersect with each other, a light emitting range can be widened from a horizontal direction towards a vertical direction. Here, if the light is emitted in only the upper direction, it becomes more difficult to recognize the upper surface of the housing as the user becomes more distant from the centrifuge. Also, if the light emitting part is provided on the front surface of the housing, the light is emitted in only the forward direction, so that it becomes difficult to recognize the housing from the upper direction. However, according to the illustrative embodiment, the light emitting part 40 is arranged at the corner portion so as to be seen from the upper direction and from the front direction, so that it can be configured to be easily recognized from various directions. In the meantime, a front-rear width of the light emitting part 40 as seen from the sectional view of FIG. 4 can be arbitrarily set. However, it is preferable that the light emitting part 40 can be seen in a band shape, when the centrifuge is seen from the front side. Also, a configuration is also possible in which the shape of the light emitting part 40 is further devised and is configured as a window having a diffusion part enabling the light to be diffused in any direction, so that a lighting situation of the light source (LEDs 42) can be seen from any direction. As the diffusion part, a surface or backside of the light emitting part 40 may be formed with a jagged shape part having a triangular sectional shape to serve as a prism, so that the light illuminated from the inside can be refracted.

Figure 5:
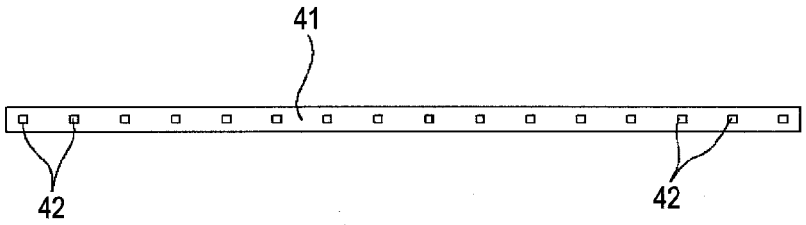
FIG. 5 is a plan view of a substrate 41 of FIG. 3.

FIG. 5 is a plan view of the substrate 41 shown in FIG. 4. Here, an example where sixteen LEDs 42 are arranged with an equal interval on the substrate 41 is shown. However, the number of the LEDs 42 is arbitrary because it is only necessary that the light emitting part 40 emits the light in a surface emitting state, not a point emitting state, by using a plurality of LEDs. The substrate 41 may be a printed board, for example. The substrate is formed thereon with a wiring (not shown), which is connected to an LED driving circuit 35 (which will be described later, refer to FIG. 6) by a lead wire (not shown). The LEDs 42 are preferably configured to change emission colors thereof. For example, 'three-color RGB LEDs', which are commercially available, may be used to emit the lights of any colors. When the LEDs 42 are configured to emit the light in the same form, an LED driver (a lighting driving circuit) can be simplified. However, a configuration is also possible in which some LEDs 42 are grouped, and the LED drivers are provided for the respective groups to light the LEDs in different display forms. Further, the LED drivers may be individually provided for each LED to implement a variety of lighting forms. In the first illustrative embodiment, one LED driver is provided for the plurality of LEDs 42 and is configured to integrally control the on/off, the emission colors, the light emitting patterns, the brightness thereof and the like.

Figure 6:
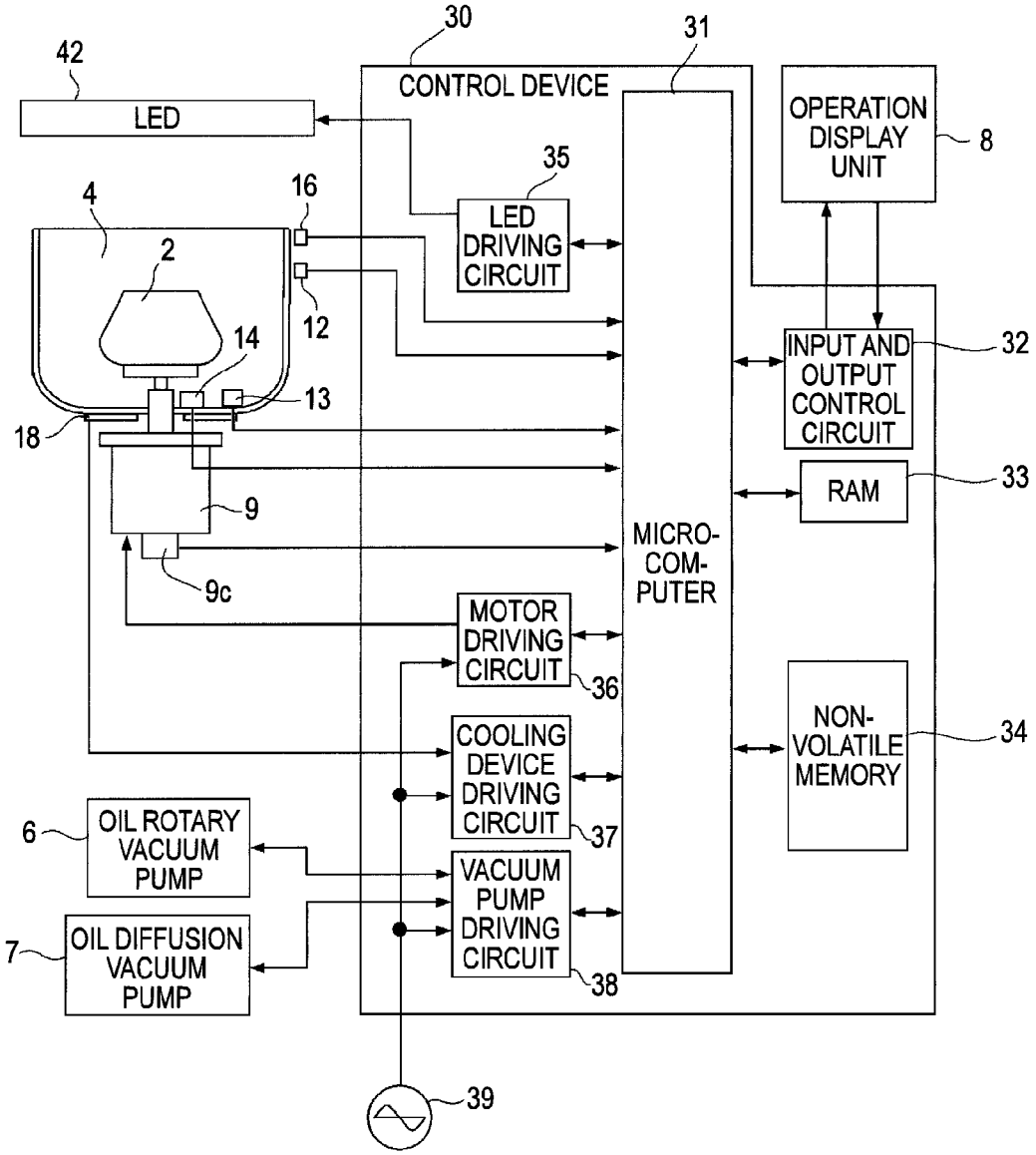
FIG. 6 is a control block diagram of the centrifuge 1 according to the illustrative embodiment of the present invention.

Subsequently, a control block diagram of the centrifuge 1 according to the illustrative embodiment of the present invention is described with reference to FIG. 6. The control device 30 has therein a microcomputer 31, a non-volatile memory 34 configured to store therein a program and control information data for operating the centrifuge, a RAM (Random Access Memory) 33 for keeping therein calculation and temporary data, an input/output control circuit 32 configured to control input and output of the operation display unit 8, which is a touch-type liquid crystal monitor, an LED driving circuit 32 configured to light the LEDs 42, a motor driving circuit 36 consisting of an inverter configured to drive the motor 9, a cooling device driving circuit 37 configured to drive a Peltier device (cooling device) for cooling the rotor, and a vacuum pump driving circuit 38 configured to drive the oil rotary vacuum pump 6 and the oil diffusion vacuum pump 7. The microcomputer 31 is connected with the temperature sensor 13 configured to measure the temperature of the rotor 2, a door sensor 16 configured to detect an opened or closed state of the door 5, the vacuum sensor 12 configured to measure a pressure in the rotor chamber 3, the rotor identifying sensor 14 configured to recognize the mounting of the rotor 2 and the identification information thereof, and a rotation sensor 9*c* configured to detect the rotation of the motor 9, of which outputs are input to the microcomputer 31. A commercial power supply 39 such as alternating current (AC) 100V or AC 200V is supplied to the motor driving circuit 36, the cooling device driving circuit 37 and the vacuum pump driving circuit 38, and the power feeding to the motor 9, the Peltier device 18, the oil rotary vacuum pump 6 and the oil diffusion vacuum pump 7 is controlled by the microcomputer 31, so that the start, stop and operations thereof are controlled. The lighting, the ON or OFF state, the emission colors, the blinking patterns, the brightness and the like of the LEDs 42 are controlled by control signals transmitted from the microcomputer 31 to the LED driving circuit 35. Since the LEDs 42 can be controlled in software manner by executing a computer program in the microcomputer 31, the microcomputer 31 can arbitrarily change the light emitting form of the LEDs 42, depending on the operating status of the centrifuge 1.

Figure 7:
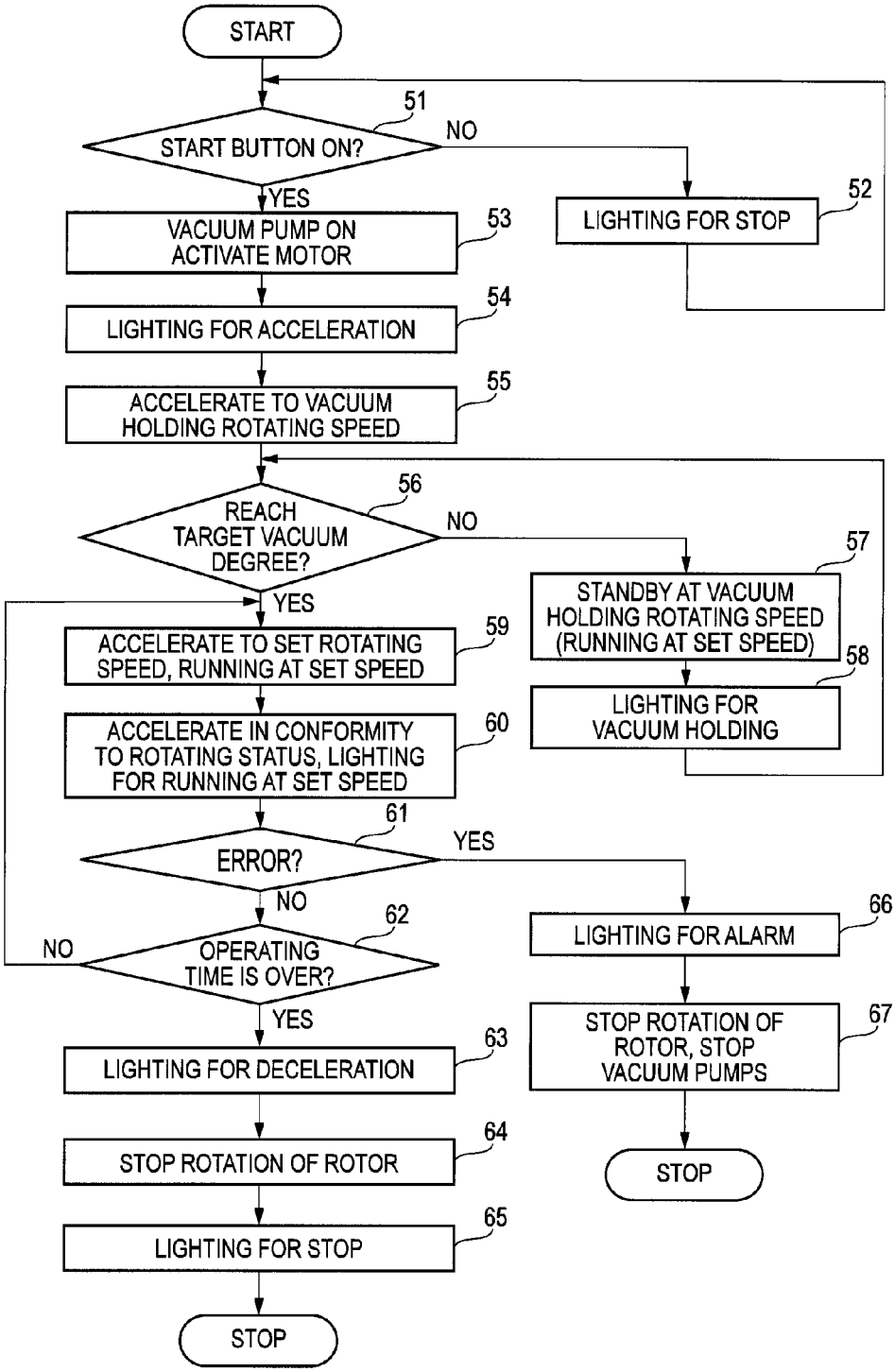
FIG. 7 is a flowchart showing a light emission control sequence of LEDs 42 according to the illustrative embodiment of the present invention.

Subsequently, a control sequence of the centrifuge 1 according to the illustrative embodiment of the present invention is described with reference to a flowchart of FIG. 7. The processing sequence thereof can be executed in software manner by executing the program with the microcomputer 31. The processing sequence starts when the user turns on the power supply switch of the centrifuge 1. First, the microcomputer 31 determines whether a start button is turned on through the operation display unit 8 by the user, which means that a centrifugal separation operation starts (step 51). Here, when the start button is not on, the microcomputer 31 turns on the LEDs 42 in a lighting form designated for a 'stop' state and returns to step 51 (step 52). When it is determined in step 51 that the start button is pressed, the microcomputer 31 turns on the vacuum pumps 6, 7 to activate the motor 9 (step 53). Then, the microcomputer 31 turns on the light emitting part 40 in a lighting form for acceleration (step 54). The control unit having activated the motor 9 accelerates the motor 9 to a predetermined low-speed rotation number, so-called vacuum holding rotating speed (step 55). Then, the microcomputer 31 determines whether the inside of the rotor chamber 3 reaches a target vacuum degree (step 56). When a result of the determination in step 56 is No, the microcomputer 31 stands by until the inside of the rotor chamber 3 reaches a target vacuum degree by the operations of the vacuum pumps 6, 7, at the running status at set speed (step 57), turns on the light emitting part 40 in a lighting form for vacuum holding and returns to step 56 (step 58). In the meantime, when the on state of the start button enabled in step 51 indicates a start of a reserved operation for performing a centrifugal separation operation in conformity to time set by a timer reservation, the microcomputer 31 may execute step 53 in conformity to the reserved time, and turn on the light emitting part 40 in a dedicated lighting form during the reservation standby.

When it is determined in step 56 that the rotor chamber 3 reaches a predetermined vacuum degree, the microcomputer 31 accelerates the motor 9 from the vacuum holding speed to the set rotating speed and constantly rotates the motor 9 at the set rotating speed (step 59). At this time, the microcomputer 31 turns on the light emitting part 40 in any one lighting form for 'acceleration' and 'running at set speed' in accordance with the rotation state of the rotor 2 (step 60). Then, the microcomputer 31 detects whether an error occurs (step 61). When it is determined that an error is detected, the microcomputer 31 turns on the light emitting part 40 in the lighting form for alarm indicating an error occurrence (step 66) and stops the rotation of the rotor 2 (step 67). After that, when a button (not shown) for stopping the vacuum pumps is pressed, the microcomputer 31 stops the vacuum pumps 6, 7 to end the centrifugal separation operation. In the meantime, the steps 61, 66, 67 of detecting an error may be interposed even after step 55 or 58.

When it is determined in step 61 that an error has not occurred, the microcomputer 31 determines whether it is time to end the centrifugal operation (step 62). When a result of the determination in step 62 is No, the microcomputer 31 returns to step 59. Otherwise, the microcomputer 31 performs a deceleration control, turns on the LEDs 42 in a lighting form for deceleration until the rotor stops (step 63). When the rotor stops, the microcomputer 31 stops the rotation of the motor 9 (step 64) and turns on the LEDs 42 in a lighting form for operation completion (step 65). After that, when the button (not shown) for stopping the vacuum pumps is pressed by the user, the vacuum pumps 6, 7 are stopped and the air leak valve 26 is released. Therefore, the door 5 can be opened and the centrifugal separation operation is over.

Figure 8:
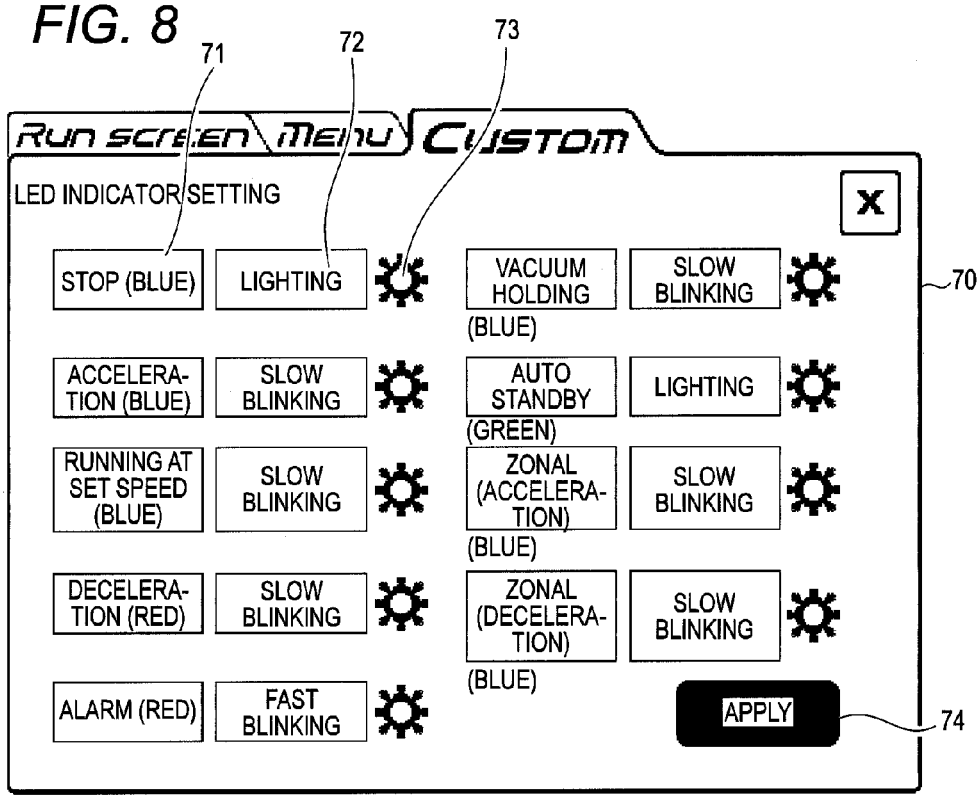
FIG. 8 illustrates a screen example for setting a light emitting form of the LEDs 42 according to the illustrative embodiment of the present invention.

Subsequently, a screen example for setting the light emitting forms of the LEDs 42 according to the illustrative embodiment of the present invention is described with reference to FIG. 8. A screen 70 is displayed on the operation display unit 8 when setting a light emitting form of the LEDs 42. On the screen 70, it is possible to arbitrarily set display forms for each of nine operating statuses (stop, vacuum holding, acceleration, reserved operation, running at set speed, deceleration, zonal acceleration, zonal deceleration and alarm). Regarding each display, an operating status 71 of the rotor 2 at the left, a corresponding display form 72 of the LEDs 42 and an icon 73 for tentative lighting of a setting are displayed. In this illustrative embodiment, the display form is set by the color, brightness, light emitting pattern and the like of the LEDs 42, so that it is possible to notify the user of an operating status of the centrifuge 1 by the light emitting form of the light emitting part 40. In the meantime, FIG. 8 illustrates a view in a black and white manner. However, the actual screen 70 is a color display. Therefore, the rectangle of the display form 72 is displayed by the same color as the designated color, so that the user can discriminate the set color at sight. In addition to the color display, a letter indicating any designated color is displayed at a left-lower portion of the rectangle of the operating status 71. In the example of FIG. 8, blue is set for stop, blue is set for acceleration, red is set for deceleration and red is set for alarm. In addition, a continuous lighting, a slow lighting and a fast lighting are variously set in the example of FIG. 8.

Figure 9:
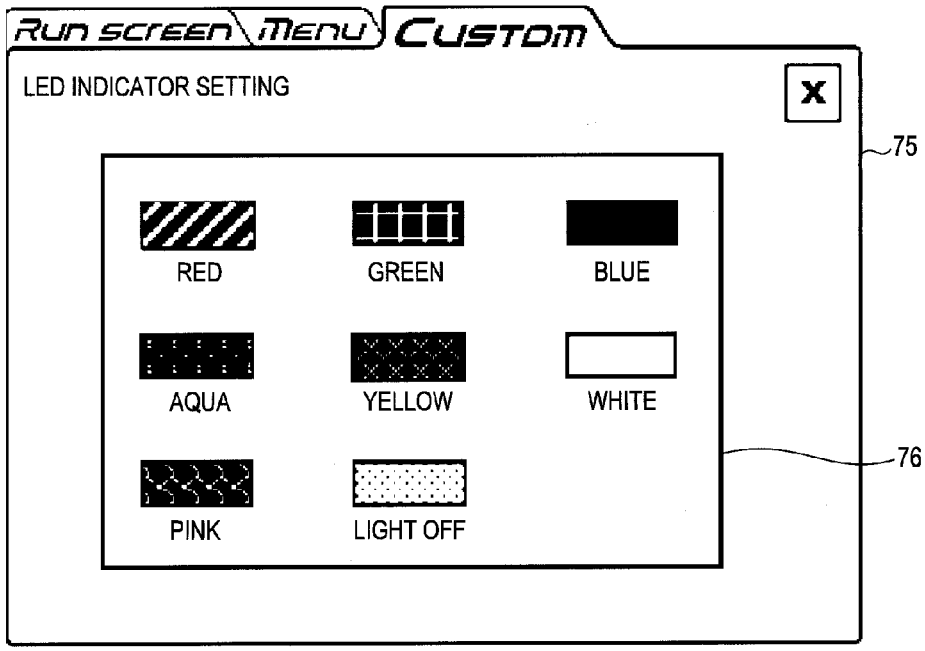
FIG. 9 illustrates a screen example for setting a light emitting form of the LEDs 42 according to the illustrative embodiment of the present invention.
Figure 10:
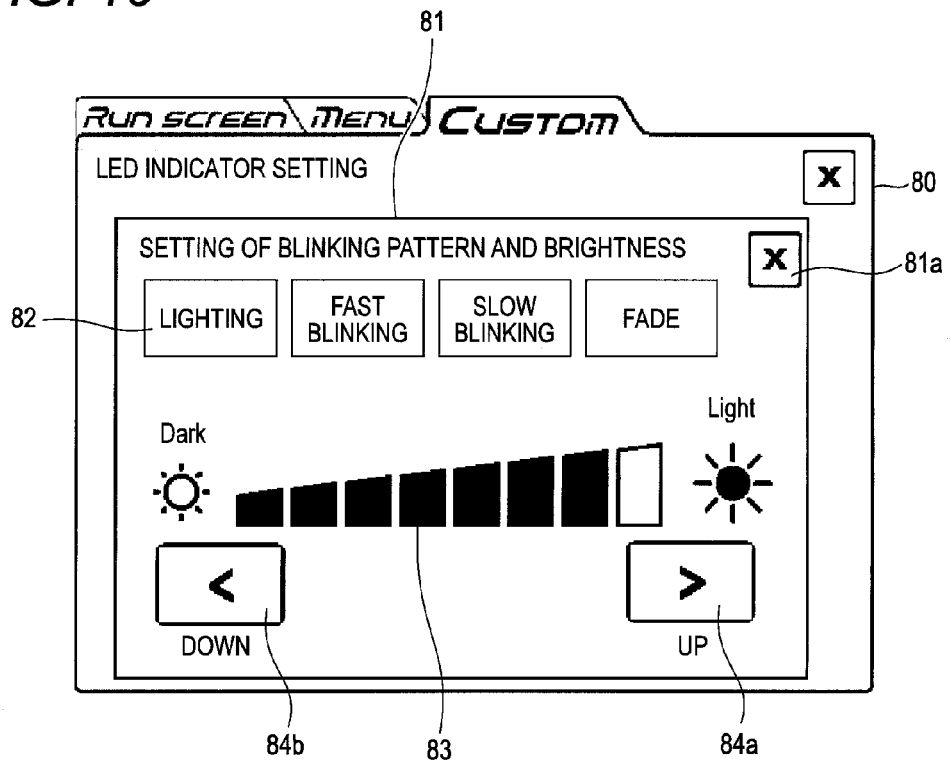
FIG. 10 illustrates a screen example for setting a light emitting form of the LEDs 42 according to the illustrative embodiment of the present invention.

In the example of FIG. 8, when the user touches a field of the specific operating status 71, the display of the operation display unit 8 is switched to a screen 75 as shown in FIG. 9. By selecting any color of the emission colors displayed on the screen 75, it is possible to arbitrarily set the display form of the selected operating status. Since FIG. 9 is shown in a black and white mode, the hatched lines and the like are used. However, the colors are actually displayed. Here, when the user selects 'light off', it is possible to turn off the light emitting part 40 at a specific operating status. When the user selects a desired color from a screen 76 of FIG. 9, a screen 80 as shown in FIG. 10 is displayed, so that a screen for setting a blinking pattern and brightness is displayed. Here, a popup screen 81 is displayed and a displayable blinking pattern is displayed in the corresponding screen by icons 82. Here, the four icons 82 are displayed, so that the user can select any one of 'lighting', 'fast blinking', 'slow blinking' and 'fade'. Then, the user selects the brightness to any one of seven levels. However, the user can arbitrarily set the brightness by adjusting a bar graph 83, which indicates a level of the brightness, with an up button 84*a* and a down button 84*b*. When the blinking pattern and brightness settings are over, the user touches a close button 81*a* to return to the screen 70 of FIG. 8.

Figure 11:
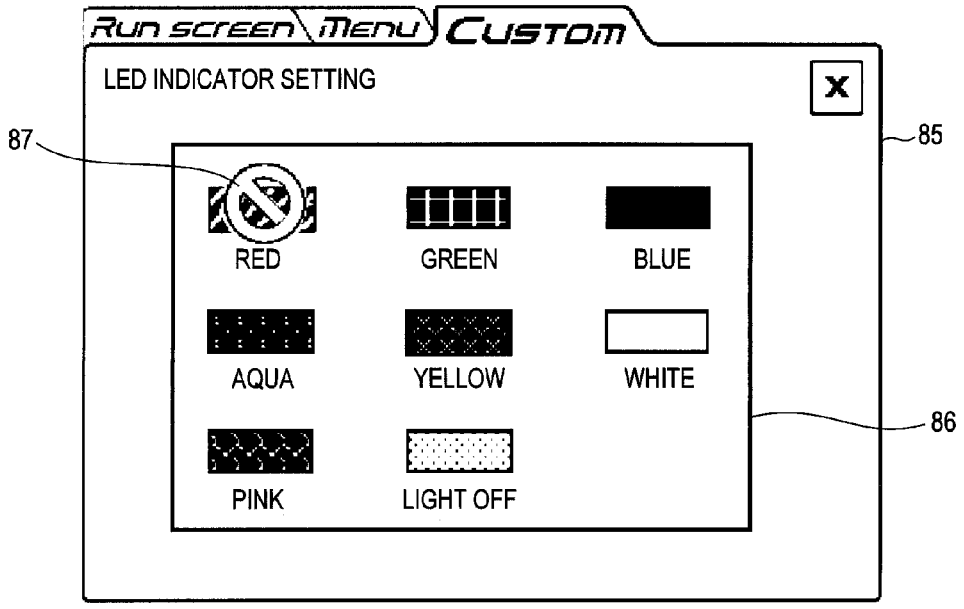
FIG. 11 illustrates an alarm display example displayed when a display color of a light emitting part 40 is selected.

As described above, according to this illustrative embodiment, since it is possible to display the light emitting part 40 with any color, blinking pattern and brightness in conformity to the operating status, the user can schematically discriminate at a glance the operating status even at a place distant from the centrifuge 1. In this illustrative embodiment, any display form is set for each operating status 71 shown in FIG. 8. However, a setting enabling the user to easily recognize the abnormality is also possible by preventing the light emitting parameters of a specific status, for example, an 'abnormal status' and the other statuses from being similar or the same. For example, in the example of FIG. 8, when the user touches the field of the specific operating status 71, the display of the operation display unit 8 is switched to the screen 75 shown in FIG. 9. At this time, a user's selection may not be received as regards an overlapping color or setting disapproval color, and a selection disapproval mark 87 may be displayed with being overlapped over the popup screen 86, as shown in FIG. 11. Even when the user touches a 'red' field on the screen, the selection on the 'red' field is not received. FIG. 12 illustrates a screen display that is displayed when the 'red' field is selected.

Figure 12A:
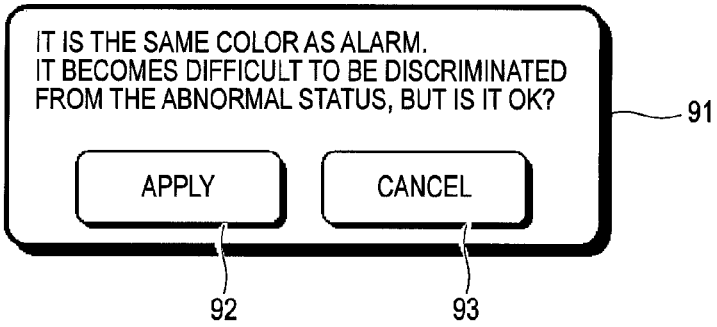
FIG. 12 (12A, 12B, 12C) illustrates a warning screen example displayed when setting a light emitting form of the LEDs 42 according to the illustrative embodiment of the present invention.
Figure 12B:
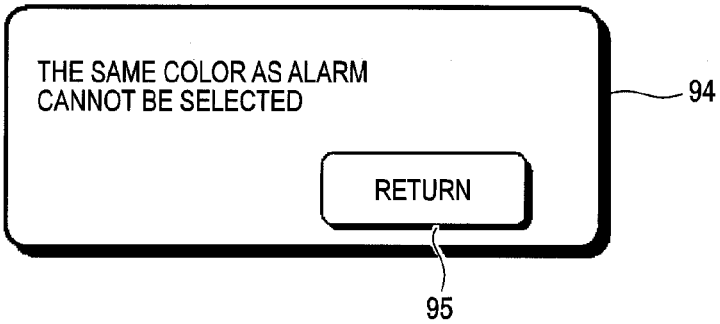

FIG. 12 illustrates an alarm display example that is displayed when a display color of the light emitting part 40 is selected. FIG. 12A is a warning screen that is displayed when the user intends to select the same color (for example, 'red') as the alarm in FIG. 9. That is, if the user is allowed to arbitrarily change the setting of the emission colors of the LEDs 42, a color with which it is difficult to recognize an abnormal status may be set, so that a necessary rapid measure may be delayed. Therefore, in this illustrative embodiment, when the user touches the red field on the screen of FIG. 9 so as to set the display color of the running at set speed to the same 'red' as the alarm, a screen 91 as shown in FIG. 12A is displayed to display a warning message indicating that the light emitting parameter set for the abnormal status of the centrifuge 1 and the light emitting parameter set for the other operating status are similar or the same, before the setting is completed. On the screen 91, a message 'It is the same color as alarm. It becomes difficult to be discriminated from the abnormal status, but is it OK?', an icon 92 for selecting 'apply' and an icon 93 for selecting 'cancel' are displayed. By the reminder screen, the user can carefully set whether a color indicating a specific operating status is set with being overlapped in the centrifuge 1.

Among the display colors indicating the specific operating statuses, the display colors may not be permitted to be changed. This is based on an idea that the light emitting pattern settable for the abnormal status of the centrifuge 1 should be more limited than the light emitting patterns settable for the other operating statuses with respect to the selection range. The range to be limited is preferably red or yellow, the brightness is preferably larger than a predetermined value and a period of the blinking pattern is preferably shorter than a predetermined value. When it is intended to prevent the change in the specific display form, for example, to prevent the change in at least the alarm color, if the color having the selection disapproval mark 97 shown in FIG. 11 is selected, a message 'the same color as the alarm cannot be selected' is displayed as a popup screen on a screen 94 of FIG. 12B and only a 'return' icon 95 is displayed.

Figure 12C:
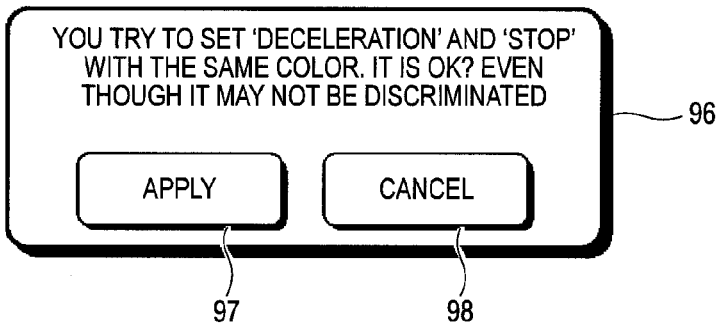

FIG. 12C shows an example of a warning against the setting of the same color. When the deceleration is selected as the operating status in FIG. 8 and any color is selected in FIG. 9, if the selected color is the same as the color indicating the other operating status, a warning message is likewise displayed before the setting is completed. Here, since the light emitting pattern set for at least one of the operating statuses of the centrifuge 1 and the light emitting pattern set for stop are similar or the same, a message is displayed like a screen 96, and an icon 97 for selecting 'apply' and an icon 98 for selecting 'cancel' are also displayed. In this way, the warning screen is provided, so that it is possible to prevent the user from erroneously allotting the same color to the plurality of operating statuses. On the other hand, even when the same color is allotted, the display forms where the one is 'lighting' and the other is 'blinking' may be different, for example. In this case, the user may select the 'apply' icon 97, irrespective of the warning screen like the screen 96, and set the blinking pattern and the brightness to be different on the following screen as shown in FIG. 10. In the meantime, the warning screen in FIG. 12C may be displayed when setting the blinking pattern and the brightness on the screen as shown in FIG. 10.

According to this illustrative embodiment, since it is possible to notify the operating status of the centrifuge by the light emitting parameters such as the color, brightness, light emitting pattern and the like displayed on the light emitting part 40 thereof, it is possible to implement the centrifuge of which operating status can be easily recognized from the outside. Also, the light emitting patterns for the abnormal status and the other statuses are prevented from being similar or the same, so that it is possible to implement the centrifuge of which abnormality can be easily recognized by the user. Further, the light emitting parameter for at least one of the operating statuses (acceleration/running at set speed/deceleration) is prevented from being similar to or the same as the parameter for the stop status, so that it is possible to prevent misidentifying whether the centrifuge is under operation or stop. When the user can recognize the stop status, the user can rapidly pull out the sample upon the stop of the rotor. Thereby, it is possible to prevent the sample from being changed (deteriorated, for example), which is caused as the sample is left along even after the centrifuge is stopped. Further, when only the light emitting pattern generally having a warning meaning is displayed upon the occurrence of the abnormality, since the corresponding light emitting pattern is not a warning depending on a color sense of a setting person, it is possible to implement the centrifuge of which abnormality can be easily recognized by a third person as well.

Second Illustrative Embodiment

Figure 13:
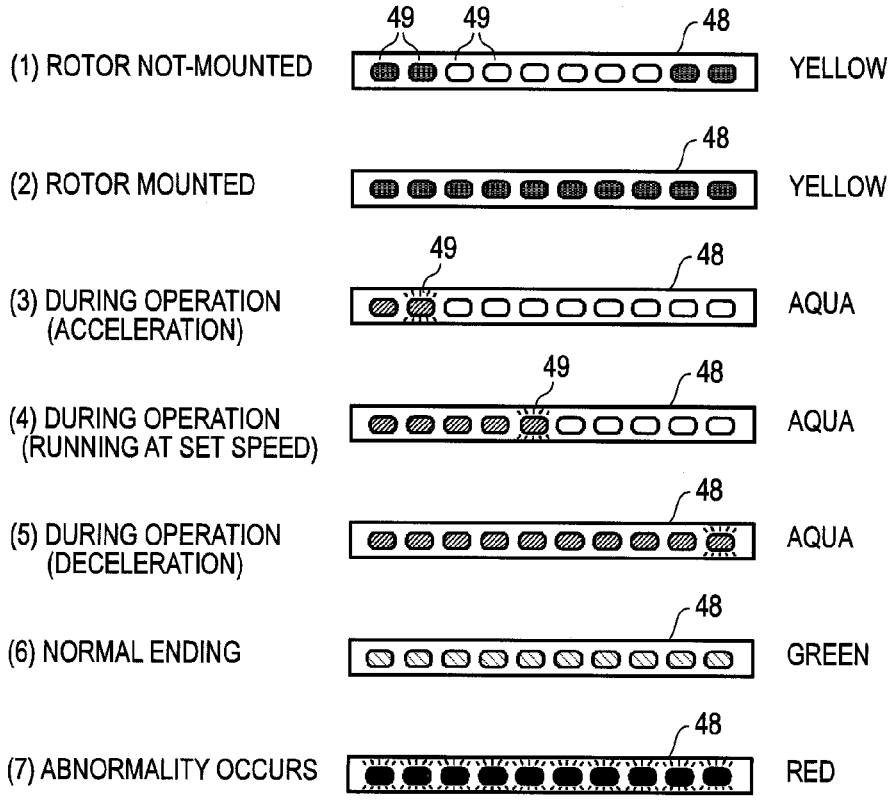
FIG. 13 illustrates examples of light emitting patterns of LEDs 49 according to a second illustrative embodiment of the present invention.

Subsequently, other display forms of the light emitting part 40 are described with reference to FIG. 13. In the first illustrative embodiment, the LEDs 42 included in the light emitting part 40 are sixteen and are lighted in the same display form by using the common driving circuit. However, in the second illustrative embodiment, a plurality of LED groups is divided into a plurality of segments, and the display form is changed for each segment to implement a variety of displays. Here, the LEDs are divided into ten segments, and a driving circuit of the LED is independently provided for each segment and is controlled by the microcomputer 31. In FIG. 13, for convenience of understanding, one color LED is allotted to each segment and is mounted on a substrate. However, the LED 49 may be in plural allotted to each segment, other than one. Instead of the substrate 41 of FIG. 4, a substrate 48 is mounted in the housing. In FIG. 13, it should be noted that a light emission surface of the LED 49 is schematically shown to be large so as to be able to show a difference between the colors with hatched lines.

In the second illustrative embodiment, seven display forms (1) to (7) are allotted to the operating statuses. In addition, the other operating statuses can be also allotted. The display form (1) indicates that the rotor is not mounted yet. In the display form (1), the LEDs 49 of the six segments in the vicinity of a center of the light emitting part are turned off and two LEDs of the two segments are lighted at both sides, respectively, which indicates that the target (rotor) is not mounted. The emission color thereof is yellow (a first color), for example. The display form (2) indicates that the rotor is mounted. In the display form (2), the LEDs 49 of the six segments in the vicinity of a center of the light emitting part are also lighted to visibly display that the target (rotor) is mounted by an increase in a display area of the LEDs. At this time, the emission color is still yellow (the first color). The yellow indicates a status where the rotor stops and the centrifugal operation is not performed yet. Then, when an operation starts, the emission color is changed to an aqua (a second color), and the LEDs 49 are sequentially lighted on from the left. For example, during the acceleration, one or two of the LEDs are lighted on from the left, as shown in the display form (3) of FIG. 13. During the running at set speed, three to eight of the LEDs are lighted from the left, as shown in the display form (4) of FIG. 13. During the deceleration, nine to ten of the LEDs are lighted from the left, as shown in the display form (5) of FIG. 13. Upon the display of (3) to (5), when the rightmost LED of the LEDs 49 being lighted is blinked, the user can easily recognize a progressing status and what percent the progressing is processed from the first.

When the centrifugal separation operation is normally over, the color of all LEDs 49 is changed to green (a third color), for example, so as to indicate the normal ending, as shown in the display form (6) of FIG. 13. At this time, although the LEDs 49 are not blinked, the setting is also arbitrary. In the meantime, when any abnormality occurs during the operation from (3) to (5), all LEDs 49 are blinked with red (a fourth color). Thereby, an alarm indicating that an error has occurred is notified to the user. In this way, according to the second illustrative embodiment, the display area of the light emitting part 40 is divided into the plurality of segments and the display of each segment is independently controlled. Therefore, it is possible to variously change the light emitting form of the band-shaped light emitting part, depending on the operating status of the centrifuge 1.

Third Illustrative Embodiment

Figure 14:
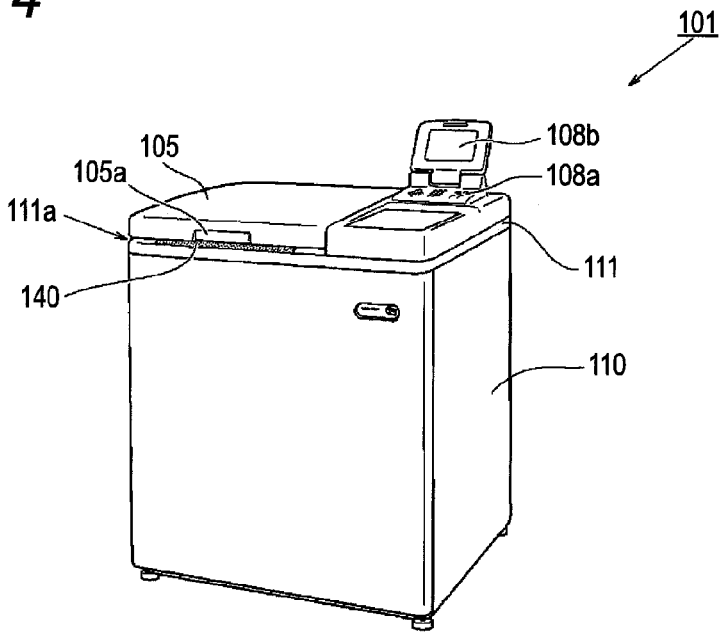
FIG. 14 is a perspective view illustrating an outward appearance of a centrifuge 101 according to a third illustrative embodiment of the present invention.

Subsequently, a third illustrative embodiment is described with reference to FIG. 14. FIG. 14 illustrates a centrifuge 101 having a configuration where a door 105 is opened and closed vertically at a front end of the door 105 about a hinge part (not shown) serving as a rotational shaft and provided in the vicinity of an upper end of a rear surface of a housing. The housing of the centrifuge 101 has a housing main body 110, a top cover 111 and the door 105. A right-upper part of the top cover 111 is provided with an input unit 108*a* for performing an input operation of centrifugal conditions and a display unit 108*b* such as a liquid crystal monitor for visibly displaying the information. The door 105 having a substantial rectangular shape, as seen from above, is provided at the left including a center of the top cover 111. In the first illustrative embodiment, the door 5 is a slide type configured to move in the horizontal direction. In the third illustrative embodiment, the door 105 is a type (a single swing type) configured to be opened upwardly using a hinge and the like. The door 105 is configured to cover an upper planar part including an opening (not shown) of the rotor chamber. A front side of the door 105 is provided with a recess-shaped handle part 105*a* for lifting up the door. When the door 105 is opened upwardly, a circular opening as shown in FIG. 2 is exposed.

In the third illustrative embodiment, a light emitting part 140 is provided at a lower side of the door 105 and at an upper end portion of the front surface of the top cover 111. The shape, length in the horizontal direction, and central position in the left-right direction and the positioning of the light emitting part 140 with the opening of the rotor chamber in the left-right direction are the same as the first illustrative embodiment. Here, a ridge line of the upper end portion of the front surface of the top cover 111 has a curve shape having a gentle radius R, as can be seen from a part indicated by an arrow 111*a*, and the light emitting part 140 also has a curve shape or an obliquely arranged planar shape. The light emission principle of the light emitting part 140 may be configured to be the same as the first illustrative embodiment. By this configuration, since a part or all of the light emitting part 140 can be visibly recognized from the front of the centrifuge 101 in the horizontal direction and from the position looking down the front of the centrifuge 101, it is possible to easily recognize the light emitting status. Further, the light emitting part 140 is provided at the position at which the user who is mounting or demounting the rotor 2 can see the light emitting part partially or entirely from above when opening the door 105. Thereby, the light emitting part 140 can be also used as a guide upon the mounting of the rotor 2. In this way, it is possible to implement the light emitting part 140 that can be easily used for also the centrifuge 101 having a single swing type door shape.

Fourth Illustrative Embodiment

Figure 15:
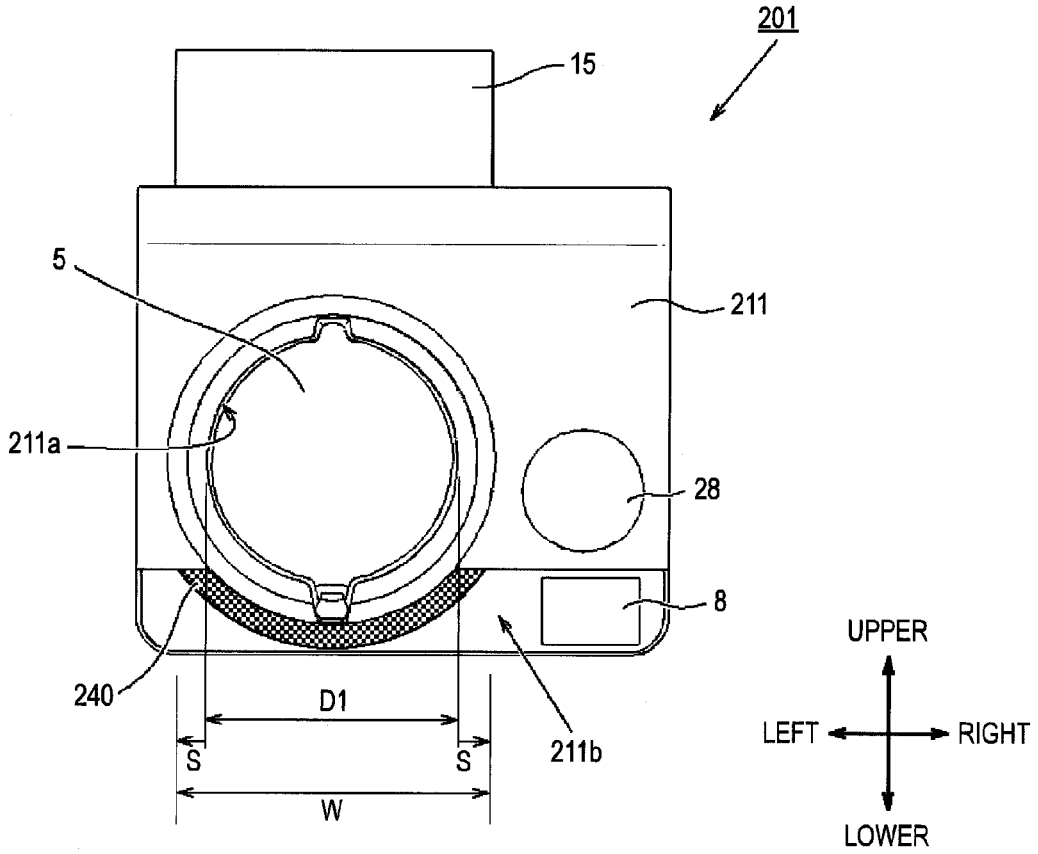
FIG. 15 is a plan view of a centrifuge 201 according to a fourth illustrative embodiment of the present invention.

Subsequently, a fourth illustrative embodiment is described with reference to FIG. 15. FIG. 15 illustrates a centrifuge 201 in which the shapes of the top cover 11 and light emitting part 40 of the first illustrative embodiment are modified. As can be understood from FIG. 2, in the centrifuge 1, while the upper surface of the front side of the opening 11*a* is substantially horizontal and is formed with the corner portion at which the light emitting part 40 is provided, the part at which the operation display unit 8 is provided is obliquely formed. In the fourth illustrative embodiment, a front end of the top cover 211 is formed with one inclined surface 211*b* having the same inclination as the part at which the operation display unit 8 is provided and continuing in the left-right direction. Here, a light emitting part 240 is provided in the vicinity of a front side of an opening 211*a* and has an arc shape so as to keep a constant distance from an outer edge of the opening 211*a*. The light emission principle of the light emitting part 240 may be configured to be the same as the first illustrative embodiment, and the light from the light emitting device arranged in the housing is illuminated to a semi-transparent material. A horizontal width W of the light emitting part 240 is preferably formed to be larger than a horizontal width D1 of the opening 211*a*. Also, central positions of the horizontal width W of the light emitting part 240 and the horizontal width D1 of the opening 211*a* in the left-right direction are preferably configured to coincide with the position of the rotary shaft of the rotor 2 in the left-right direction.

In this way, according to the fourth illustrative embodiment, the inclined surface is formed between the opening 211*a* of the top cover 211 and the front side edge and the light emitting part 240 longer than the opening 211*a* in the horizontal direction is provided on the inclined surface. Therefore, it is possible to provide the light emitting part 240 capable of functioning as a guide upon the mounting of the rotor 2. Also, since the light emitting part 240 is provided on the part of the top cover 211, which is formed as the inclined surface, the user can easily recognize the light emitting status of the light emitting part 240 from the above and from the front. In the meantime, the fourth illustrative embodiment can be further modified. For example, the shape of the light emitting part 240, particularly, an area of the light emission surface is arbitrary and may be further narrowed or widened. Also, a light emission surface corresponding to a front half circle of the opening 211*a* may be configured so as to further cover the opening 211*a*. Alternatively, a light emission surface having an annular shape configured to cover an entire outer periphery of the opening 211*a* may be formed.

Although the present invention has been described with reference to the illustrative embodiments, the present invention is not limited to the above illustrative embodiments and can be variously changed without departing from the scope thereof. For example, in the first illustrative embodiment, the light emitting part 40 is provided at the corner portion at which the upper surface and the front surface of the housing intersect with each other. However, the light emitting part may be provided at any portion of the top cover 11 from the opening of the rotor chamber to the front end portion of the housing, or may be provided on the front surface of the top cover 11 at a lower side of the light emitting part 40 of FIG. 2 and at an upper side of the coupling part 10*a* with the housing main body part 10, without being limited to the ridge part. That is, regarding a centrifuge having an opening for mounting and demounting a rotor formed on a housing upper surface, a light emitting part may be provided at a front side of the opening on the housing upper surface or at a ridge part at which the housing upper surface and the housing front surface intersect with each other or in the vicinity thereof. Also in this case, the light emitting part is preferably formed to have a band shape or an arc shape in a horizontal direction, is preferably arranged so that a central position thereof in the left-right direction coincides with the position of the rotary shaft of the rotor 2 in the left-right direction, and is preferably formed to have a width (a length in the left-right direction) larger than the diameter of the opening 11*a*. Also, when forming the light emitting part at the front of the opening on the housing upper surface, if a part ranging from the opening on the housing upper surface to the ridge part is configured to be inclined downwards, it is possible to expand the light emitting direction of the light emitting part to the above and the front, so that it is possible to improve the visibility from a distance.

The present invention provides illustrative, non-limiting examples as follows:

(1) A centrifuge including: a rotor; a rotor chamber accommodating therein the rotor and having an opening; a motor configured to rotate the rotor; a door configured to close the opening of the rotor chamber; an input/output unit configured to receive an input of an operating condition and to display an operating status; and a housing accommodating therein the rotor, the rotor chamber, the motor, the door and the input/output unit, wherein the housing has the opening at an upper surface thereof, wherein a light emitting part having a horizontal width longer than the opening is provided in the vicinity of a corner portion at which the upper surface and a front surface of the housing intersect with each other or in the vicinity of a front side of the opening, and wherein a light emitting form of the light emitting part is configured to be changed depending on the operating status of the centrifuge.

(2) The centrifuge according to claim 1), wherein the light emitting part is provided between the opening and the front surface of the housing.

(3) The centrifuge according to (1) or (2), wherein the light emitting part is provided at the front side of the opening so that a longitudinal direction thereof is positioned horizontally, and wherein the light emitting part is arranged so that a position of a shaft center of the rotor in a left-right direction and a position of a center of the light emitting part in the left-right direction coincide with each other.

Accordingly, a length of the light emitting part is configured to be longer than an outer diameter of the rotor or a width of the opening for rotor mount provided on the housing upper surface and the light emitting part is arranged at a position at which the opening is covered. Thereby, when the rotor is mounted from any position of the front side of the centrifuge, it is possible to visibly recognize the upper surface of ridge part of the centrifuge housing. Also, it is possible to reduce a human error that the rotor and the centrifuge collide with each other upon the mounting of the rotor. In particular, since the horizontal length of the light emitting part is lengthened, it is possible to obtain an effect that it is easy to position the rotor at the center in the left-right direction. Further, it is also possible to use the light emitting part for showing the operating statuses such as operating, stop and the like. When the light emitting part is arranged at the corner portion (ridge part) at which the upper surface and front surface of the housing intersect with each other, it is possible to visibly recognize the light emitting part from a wide range of positions.

(4) The centrifuge according to any one of (1) to (3), wherein the light emitting part includes, a plurality of LEDs arranged inside the housing, and a transparent or semi-transparent transmission part or a window part provided in the vicinity of the corner portion of the housing and enabling light from the LEDs to penetrate therethrough.

Accordingly, even when the rotor erroneously collides with the corner portion, a concern that the LED, which is the light emitting device, will be damaged is reduced. Also, since the light is enabled to penetrate the transparent or semi-transparent member, it seems that a band-shaped light emitting part having a predetermined width in the front-rear direction is emitting the light, which improves the visibility. Also, when the light is enabled to emit through the semi-transparent member, it is possible to prevent a user from feeling the LED light as dazzling. Further, when the light is enabled to penetrate a window part such as a slit provided for the housing, it is not necessary to attach or cast a separate member because it is only necessary to process the constitutional member of the housing.

(5) The centrifuge according to (4), wherein the light emitting part is configured by LEDs capable of color display or a plurality of different LEDs of a plurality of different colors.

Accordingly, it is possible to implement a variety of display forms by the color display.

(6) The centrifuge according to (4) or (5), wherein the light emitting part is arranged so that illumination by the LEDs includes light emission components in a front direction and an upper direction from the housing, and wherein an illumination angle within a plane including upper, lower, front and rear directions is larger than 0° and smaller than 90° (upper side in a vertical direction) with reference to a horizontal forward direction from the housing.

(7) The centrifuge according to (6), wherein the illumination angle is equal to or larger than 30° and equal to or smaller than 60°.

Accordingly, when mounting the rotor, it is possible to easily recognize the light emitting part even from the upper side of the corner portion, and to easily recognize the light emitting form of the light emitting part even at a place distant from the centrifuge.

(8) The centrifuge according to any one of (1) to (7), wherein a combination of an emission color, a brightness and a light emitting pattern of the LEDs is allotted in correspondence to an operation of the centrifuge, and wherein a light emitting form indicating operating statuses of stop, acceleration, running at set speed and deceleration of the rotor are configured to be different from a light emitting form indicating abnormality in the centrifuge.

(9) The centrifuge according to any one of (1) to (8), wherein the light emitting form of the light emitting part, which corresponds to an operation of the centrifuge, is configured so that it can be arbitrarily changed by a user.

Accordingly, since it is possible to prevent the light emitting parameter of at least one of the operating statuses (acceleration/running at set speed/deceleration) from being similar to or the same as the light emitting parameter of the stop status, it is possible to effectively prevent the user from misidentifying whether the centrifuge is under operation or stop.

According to the above-described aspects, since it is possible to visibly recognize the upper surface or ridge part of the centrifuge housing by the light emitted from the light emitting part and the light emitting part functions as a guide for mount upon the mounting of the rotor, it is possible to implement the centrifuge in which the rotor can be easily mounted. Also, since the light emitting part functioning as the guide is also used as an indicator of the operating statuses such as operation, stop and the like, it is possible to easily check the operating status of the centrifuge from the lighting status of the light emitting part even at a position distant from the centrifuge.

What is claimed is:

1. A centrifuge comprising:

a rotor;

a rotor chamber accommodating therein the rotor and having an opening;

a motor configured to rotate the rotor;

a door configured to close the opening of the rotor chamber;

an input/output unit configured to receive an input of an operating condition and to display an operating status; and a housing inlcuding the rotor, the rotor chamber, the motor, the door and the input/output unit, wherein the housing has the opening at an upper surface thereof, wherein a light emitting part having a horizontal width longer than the opening is provided in the vicinity of a corner portion at which the upper surface and a front surface of the housing intersect with each other or in the vicinity of a front side of the opening, and wherein a light emitting form of the light emitting part is configured to be changed depending on the operating status of the centrifuge, wherein a combination of an emission color, a brightness and a light emitting pattern of LEDs is allotted in correspondence to an operation of the centrifuge, and wherein a light emitting form indicating at least one operating status of stop, acceleration, running at set speed and deceleration of the rotor is configured to be different from a light emitting form indicating abnormality in the centrifuge.

2. The centrifuge according to claim 1, wherein the light emitting part is provided between the opening and the front surface of the housing.

3. The centrifuge according to claim 1, wherein the light emitting part is provided at the front side of the opening so that a longitudinal direction thereof is positioned horizontally, and wherein the light emitting part is arranged so that a position of a center of the rotor in a left-right direction and a position of a center of the light emitting part in the left-right direction coincide with each other.

4. The centrifuge according to claim 1, wherein the light emitting part includes, the LEDs arranged inside the housing, and a transparent or semi-transparent transmission part or a window part provided in the vicinity of the corner portion of the housing and enabling light from the LEDs to penetrate therethrough.

5. The centrifuge according to claim 4, wherein the light emitting part is configured by the LEDs capable of color display or a plurality of different LEDs of a plurality of different colors.

6. The centrifuge according to claim 4, wherein the light emitting part is arranged so that illumination by the LEDs includes light emission components in a front direction and an upper direction from the housing, and wherein an illumination angle within a plane including upper, lower, front and rear directions is larger than 0° and smaller than 90° (upper side in a vertical direction) with reference to a horizontal forward direction from the housing.

7. The centrifuge according to claim 6, wherein the illumination angle is equal to or larger than 30° and equal to or smaller than 60°.

8. The centrifuge according to claim 1, wherein the light emitting form of the light emitting part, which corresponds to an operation of the centrifuge, is configured so that it can be arbitrarily changed by a user.

* * * * *